US005647314A

United States Patent [19]

Matsumura et al.

[11] Patent Number: 5,647,314

[45] Date of Patent: Jul. 15, 1997

[54] SUCTION SILENCER APPARATUS

[75] Inventors: Yasuo Matsumura; Kazuo Hashiba; Seijiro Sone, all of Wako, Japan

[73] Assignee: Honda Giken Kogyo Kabushikikaisha, Tokyo, Japan

[21] Appl. No.: 563,389

[22] Filed: Nov. 28, 1995

[30] Foreign Application Priority Data

Dec. 1, 1994 [JP] Japan ..... 6-321159

[51] Int. Cl.[6] ..... F02M 35/12

[52] U.S. Cl. ..... 123/184.57; 181/229

[58] Field of Search ..... 123/189.57, 184.56, 123/184.21, 198 E; 181/229, 238

[56] References Cited

U.S. PATENT DOCUMENTS

| | | | |
|---|---|---|---|
| 2,815,742 | 12/1957 | Kiekhaffer | 123/198 E |
| 3,557,902 | 1/1971 | Brown | 123/198 E |
| 4,109,751 | 8/1978 | Kabele | 181/229 |
| 4,420,063 | 12/1983 | Bohlmann et al. | 181/229 |
| 4,620,607 | 11/1986 | Breckenfeld et al. | 123/198 E |
| 5,164,550 | 11/1992 | Beidl et al. | 181/229 |
| 5,349,141 | 9/1994 | Horibe et al. | 181/229 |
| 5,490,484 | 2/1996 | Rutschmann | 123/184.57 |

FOREIGN PATENT DOCUMENTS 4-318269 11/1992 Japan .

*Primary Examiner*—Marguerite McMahon

*Attorney, Agent, or Firm*—Nikaido Marmelstein Murray & Oram LLP

[57] ABSTRACT

A suction silencer apparatus having a high silencing performance and a superior space efficiency is provided. The suction silencer apparatus is installed on an engine having a plurality of silencer chambers on a suction passage and includes a first silencer chamber surrounding a bent portion of the suction passage and communicating with the suction passage, a second silencer chamber arranged integrally with the first silencer chamber at an inner side of the bent portion of the suction passage, and a connecting device arranged at the inner side of the bent portion of the suction passage for connecting the first silencer chamber with the second silencer chamber.

20 Claims, 7 Drawing Sheets

SUCTION SILENCER APPARATUS

BACKGROUND OF THE INVENTION

The present invention relates to a suction silencer apparatus provided in a suction system of an engine for vehicle.

In the engine for vehicle, air purified by an air cleaner is mixed with a fuel and sucked in a combustion chamber to be burned.

Since the air cleaner produces a suction sound by air flow when it sucks the air and sometimes it becomes a cause of noises, an air intake of the air cleaner has been formed by a duct and a silencer apparatus has been provided on the duct.

In an example described in Japanese Laid-Open Patent Publication HEI 4-318269, a plurality of silencer apparatuses are arranged in order along a suction passage of the duct and by means of the plurality of silencer apparatuses an effective silence can be achieved covering a wide frequency zone.

However, according to the example of the Japanese Publication, because a plurality of silencer apparatuses are arranged on different positions of the duct respectively, the space efficiency is inferior and it is impossible to utilize a space effectively.

SUMMARY OF THE INVENTION

The present invention is accomplished in view of the above-mentioned points and an object of the present invention is to provide a suction silencer apparatus which can insure a high silencing performance and has a superior space efficiency.

In order to attain the above object, according to the present invention, there is provided a suction silencer apparatus of an engine having a plurality of silencer chambers on a suction passage, comprising a first silencer chamber surrounding a bent portion of the suction passage and communicating with the suction passage, a second silencer chamber arranged integrally with, the first silencer chamber at an inner side of the bent portion of the suction passage, and connecting means arranged at the inner side of the bent portion of the suction passage for connecting the first silencer chamber with the second silencer chamber.

Since the first and second silencer chambers are integrally arranged in one place on the bent portion of the suction passage, it is possible to insure a high silencing performance by the plurality of silencer chambers. Since the bent portion of the suction passage is utilized and second silencer chamber and the connecting means are positioned at inside of the bent portion, an improved space efficiency and an effective space utilizing are attainable.

The silencer apparatus having the first and second silencer chambers integrally connected to be reinforced with each other has an improved rigidity and it is advantageous for reducing vibration of the silencer apparatus itself.

According to another feature of the present invention, there is provided a suction silencer apparatus of an engine having a plurality of silencer chambers on a suction passage, comprising a silencer apparatus surrounding a bent portion of the suction passage, a partition wall partitioning an interior of the silencer apparatus into outer and inner portions positioned on outer and inner sides of the bent portion respectively, a silencer expansion chamber formed by the outer portion in the silencer apparatus, a silencer resonance chamber formed by the inner portion in the silencer apparatus, and a connecting pipe for connecting the silencer expansion chamber with the silencer resonance chamber arranged at the inner side of the bent portion extruding into the resonance silencer chamber.

Since the silencer apparatus is provided in one place on the bent portion of the suction passage, a good suction efficiency is obtainable, and since the resonance chamber is provided on the inner side of the bent portion of the suction passage and the connecting pipe extrudes to the side of the resonance chamber, a high space efficiency is obtainable, further since the interior of the silencer apparatus is partitioned by the partition wall to form the expansion chamber and the resonance chamber, a high silencing performance can be maintained.

In addition, the silencer apparatus having the expansion chamber and the resonance chamber integrally connected to be reinforced with each other has an improved rigidity and it is advantageous for reducing vibration of the silencer apparatus itself.

DETAILED DESCRIPTION OF THE PREFERRED EMBODIMENT

Figure 1:
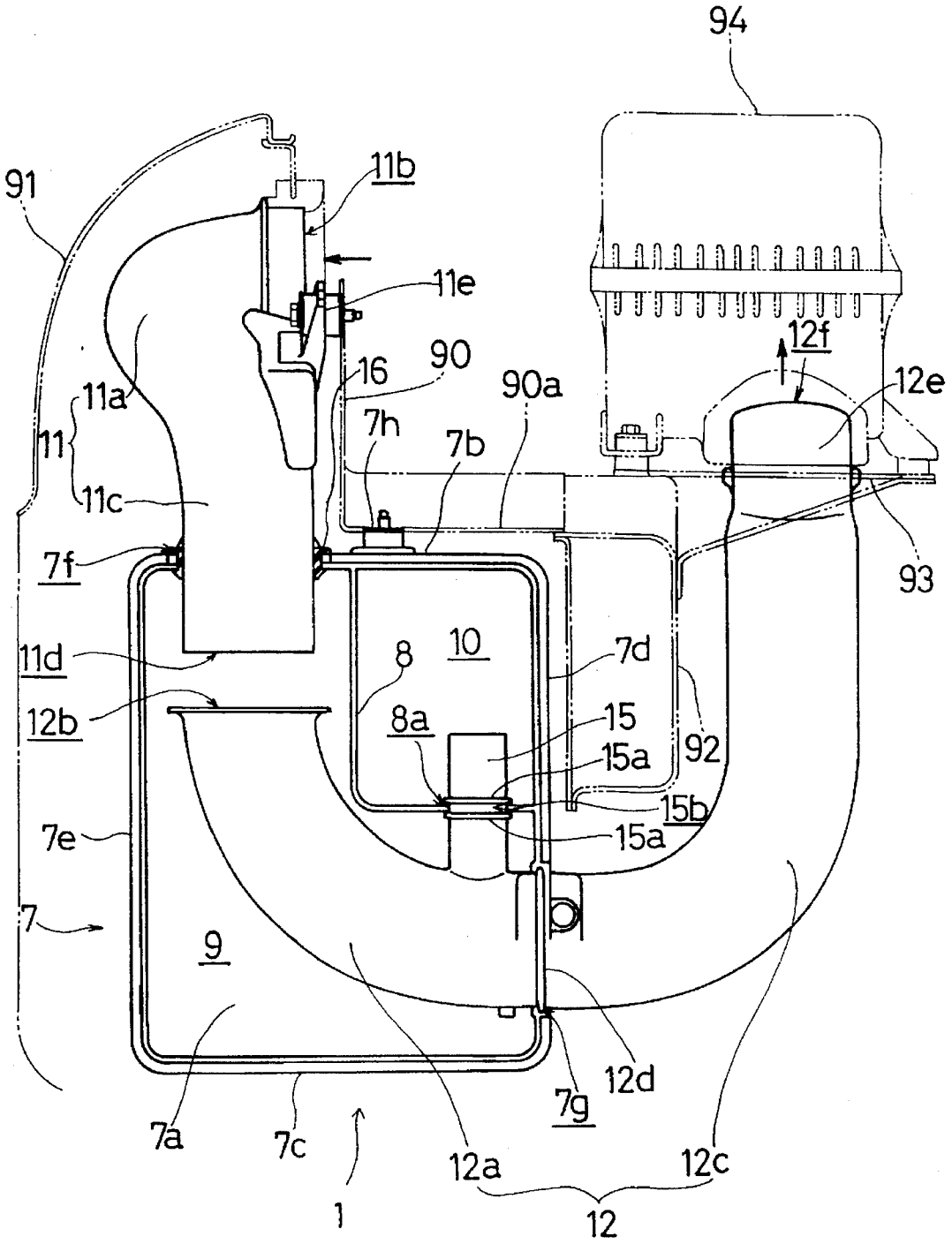
FIG. 1 is a front view of a suction silencer apparatus according to an embodiment of the present invention in which a front side case is removed.
Figure 2:
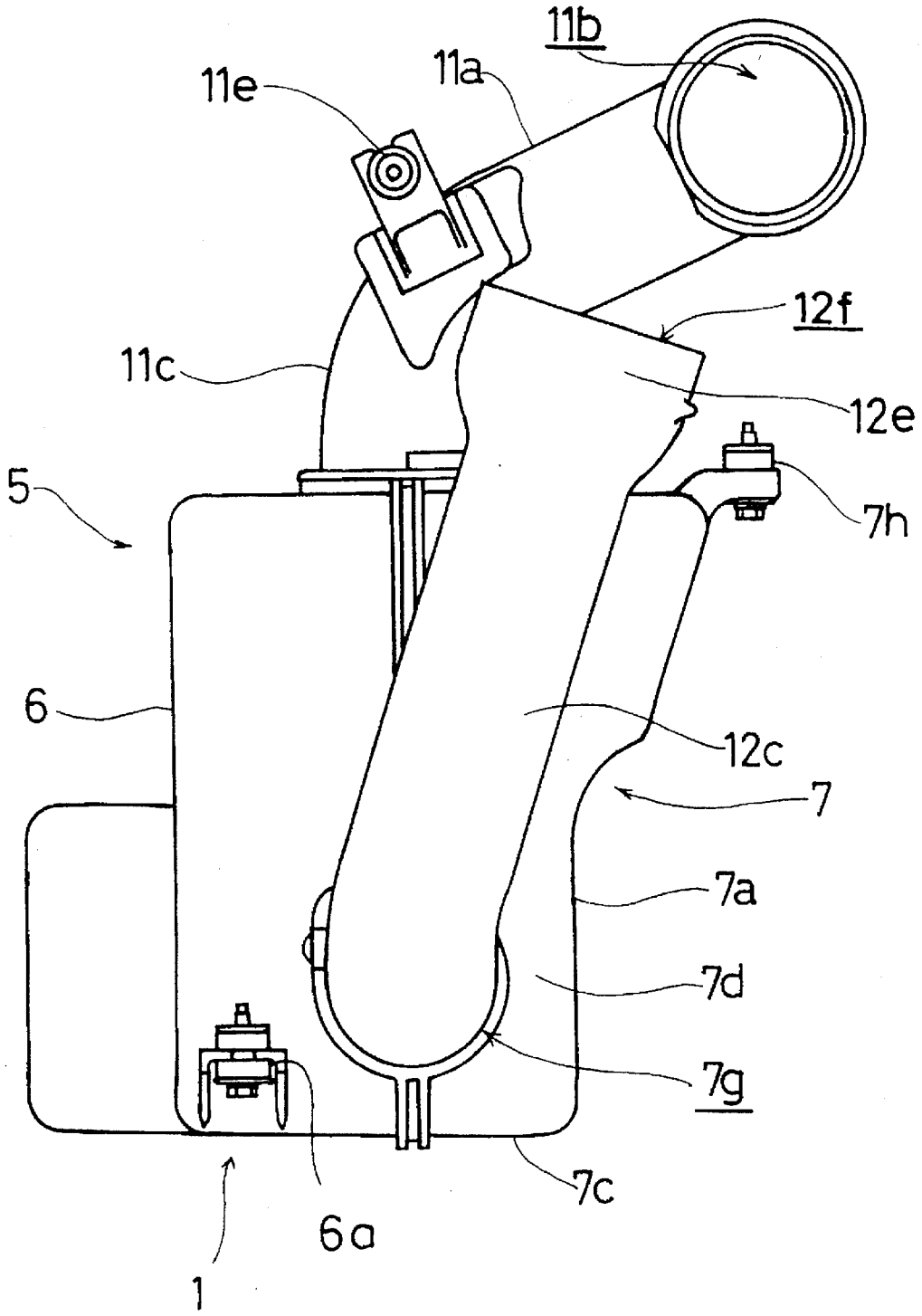
FIG. 2 is a side view of the entire of the suction silencer apparatus.
Figure 3:
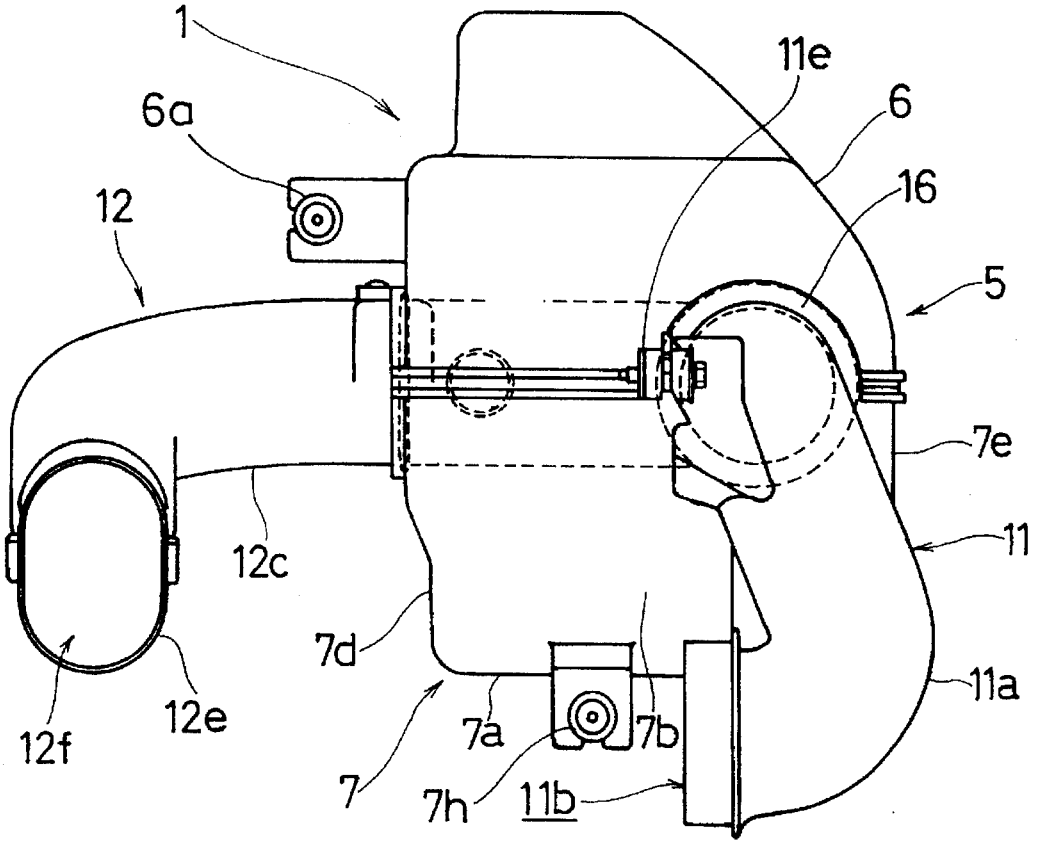
FIG. 3 is a plan view thereof.

Hereinafter, a preferred embodiment of the present invention will be described with reference to FIGS. 1 to 3. FIG. 1 is a partly omitted front view of a suction silencer apparatus according to the embodiment, FIG. 2 is a side view of the entire and FIG. 3 is a plan view thereof.

A suction duct is formed of a first duct member 11 on the upstream side and a second duct member 12 on the downstream side, and a silencer case 5 partly surrounding and connecting the both duct members 11, 12 is provided.

The suction silencer apparatus 1 is arranged in a wheel house 90 on the right side of an engine room of a vehicle body, and attached to a wheel apron 90*a* bent to an inner side of the wheel house 90 as shown by the double dotted chain line in FIG. 1. The right side (left side in the drawing) of the suction silencer apparatus 1 is covered by a fender 91.

The inner portion of the wheel apron 90*a* is hung down and there is formed a side frame 92 directed in before and behind. An air cleaner stay 93 is projected from the upper portion of the side frame 92 into the interior of the vehicle body, and an air cleaner 94 is fixed on the air cleaner stay 93 and the wheel apron 90*a*.

The first duct member 11 of the suction silencer apparatus 1 extends upwardly from the silencer case 5. The upstream side half portion 11*a* of the duct member 11 is bent and provided with an air intake 11*b* directed leftward. The downstream side half portion 11*c* of the duct member 11 extends straight downward to a downstream side opening 11*d*. An attachment member 11*e* to the wheel house is projected at a boundary portion between the upstream side half portion 11*a* and the downstream side half portion 11*c*.

On the other hand, the second duct member 12 is bent in a J-shape and a shorter upstream side half portion 12*a* thereof has a upstream side opening 12*b* opposing the downstream side opening 11*d* of the first duct member at a predetermined interval. On the downstream side of the upstream side half portion 12*a* is formed a connecting pipe 15 of small diameter projecting toward an inside of the bend. The connecting pipe 15 has two circumferential projection lines 15*a*, 15*a* in parallel with each other at a predetermined position of the outer peripheral surface, and a groove line 15*b* is formed between the projection lines 15*a*, 15*a*.

A longer downstream side half portion 12*c* of the second duct member 12 has a circumferential projection line 12*d* formed at a boundary portion to the upstream side half portion 12*a*, and bends upwardly from the boundary portion to pass through the air cleaner stay 93. A downstream side connecting portion 12*e* at the upper end is fitted into the air cleaner 94 from the bottom to be connected thereto.

The section of the downstream side connecting portion 12*e* is deformed in a elliptical shape and the elliptical opening 12*f* faces upward in the same way as the upstream side opening 12*b* of the upstream side half portion 12*b* to open within the air cleaner 94.

The silencer case 5 is split into a front side case 6 and a rear side case 7 which are combined together pinching the first duct member 11 and the second duct member 12 therebetween.

The front and rear cases 6, 7 are shaped similarly like boxes of rectangular parallelepiped in general, and joint faces of both cases 6, 7 are formed symmetrically with each other. Accordingly the explanation will be made as to the rear side case 7 with reference to FIG. 1 showing a state that the front side case 6 is removed.

The rear side case 7 forms a box having a rear wall 7*a* as a bottom plate and upper, lower, left and right side walls 7*b*, 7*c*, 7*d* and 7*e*. At a right part of the upper wall 7*b* is formed a semicircular recess 7*f*, at a lower part of the left side wall 7*d* is formed a semicircular recess 7*g* and along an inner peripheral surface of the recess 7*g* is provided a groove line.

A left side portion of the upper wall 7*b* and upper side portion of the left side wall 7*d* form two sides of a rectangle and other two sides of the rectangle are formed by a partition wall 8.

That is, the space within the rear side case 7 is partitioned by the partition wall 8 to form the rectangle at the left upper part and a first silencer chamber 9 bent in a L-shape and a second silencer chamber 10 of rectangular shape are formed.

At a lower wall of the partition wall 8 is formed a semicircular recess 8*a*.

The shape of interior and joint face of the front side case 6 is formed in symmetry with those of the rear side case 7. However, the rear wall 7*a* of the rear side case 7 has a rearward swelled portion at the upper part from which an attachment portion 7*h* to the wheel apron projects, and the front side case 6 has a projected attachment portion 6*a* (FIGS. 2 and 3) at the lower part Of the left side wall which is attached to the side frame 92 through a not shown stay.

In the semicircular recess 7*f* provided on the upper wall 7*b* of the rear side case 7 shaped as mentioned above is fitted the downstream side half portion 11*c* of the first duct member 11 through an annular rubber seal member 16, in the groove line of the semicircular recess 8*a* provided on the left side wall 7*b* of the rear side case 7 is fitted the projection line 12*d* of the second duct member 12 and in the semicircular recess 8*a* of the partition wall 8 is fitted the groove line 15*d* of the connecting pipe 15.

FIG. 1 shows such a state as mentioned above. The first duct member 11 enters into the first silencer chamber 9 of the rear side case 7 through the Upper wall 7*b*, the upstream side half portion 12*a* of the second duct member 12 is accommodated along the L-shaped first silencer chamber 9, and the connecting pipe 15 branching from the upstream side half portion 12*a* enters into the second silencer chamber 10 through the partition wall 8.

The downstream side opening 11*d* of the first duct member 11 and the upstream side opening 12*b* of the second duct member 12 face to each other at a predetermined interval within the silencer chamber 9 and the first duct member 11 and the second duct member 12 form an about U-shaped bent configuration in its entirety.

FIGS. 2 and 3 show the apparatus after the rear side case 7 in the state as mentioned above is covered by the front side case 6 from the front and the cases 7, 6 are combined. The interior of the silencer case 5 is perfectly partitioned into the first silencer chamber 9 and the second silencer chamber 10 and the silencer case 5 is provided being biased to a right bent portion of the duct member 11, 12 bending in about U-shape. The first duct member 11 and the second duct member 12 are fitted in the first silencer chamber 9 of the silencer case 5 and the second silencer chamber 10 is positioned at the inner side of the bent portion of the duct member 11, 12.

The silencer case 5 is fixed to the wheel apron 90*a* at the attachment portion 7*h*. The first duct member 11 is fixed to the wheel house 90 at the attachment portion 11*e* and pinched by the front and rear cases 6, 7 so that the first duct member 11 is fixed and supported firmly. The second duct member 12 is pinched and supported by the front and rear cases 6, 7 with the central projection line 12*d* and the groove line 15*b* of the connecting pipe 15 fitted to the recesses of the cases 6, 7, so that the duct member 12 is fixed firmly to prevent its vibration.

In the above described suction silencer apparatus 1, the opening 11*d* of the first duct member 11 and the opening 12*b* of the second duct member 12 are faced to each other within the first silencer chamber 9 so as to reduce suction noise by expansion of the air and the connecting pipe 15 branching from the second duct member 12 enters into the second silencer chamber 10 and connects the second duct member 12 with the second silencer chamber 10 so as to reduce suction noise by resonance, therefore a high silencing performance can be insured.

Since the first silencer chamber 9 and the second silencer chamber 10 are provided concentrated at one place of the duct member 11, 12 in place of arranging silencer apparatuses at different places on a suction passage, attaching of silencer chambers is easy.

Since the silencer case 5 is provided on a part of the duct member 11, 12 bent in about U-shape and the second silencer chamber 10 is positioned utilizing the space on the inner side of the bent portion of the duct member 11, 12, the space efficiency is high, the space can be utilized effectively and freedom of layout is high.

Since the silencer case 5 is arranged in the space enclosed by the wheel house 90, the fender 91 and the side frame 92 which is separated from the engine room, temperature change of the silencer case 5 is small and the case 5 is maintained at a relatively low temperature, so that the silencing performance is more improved.

Next, another embodiment will be described with reference to FIGS. 4 to 6.

Figure 4:
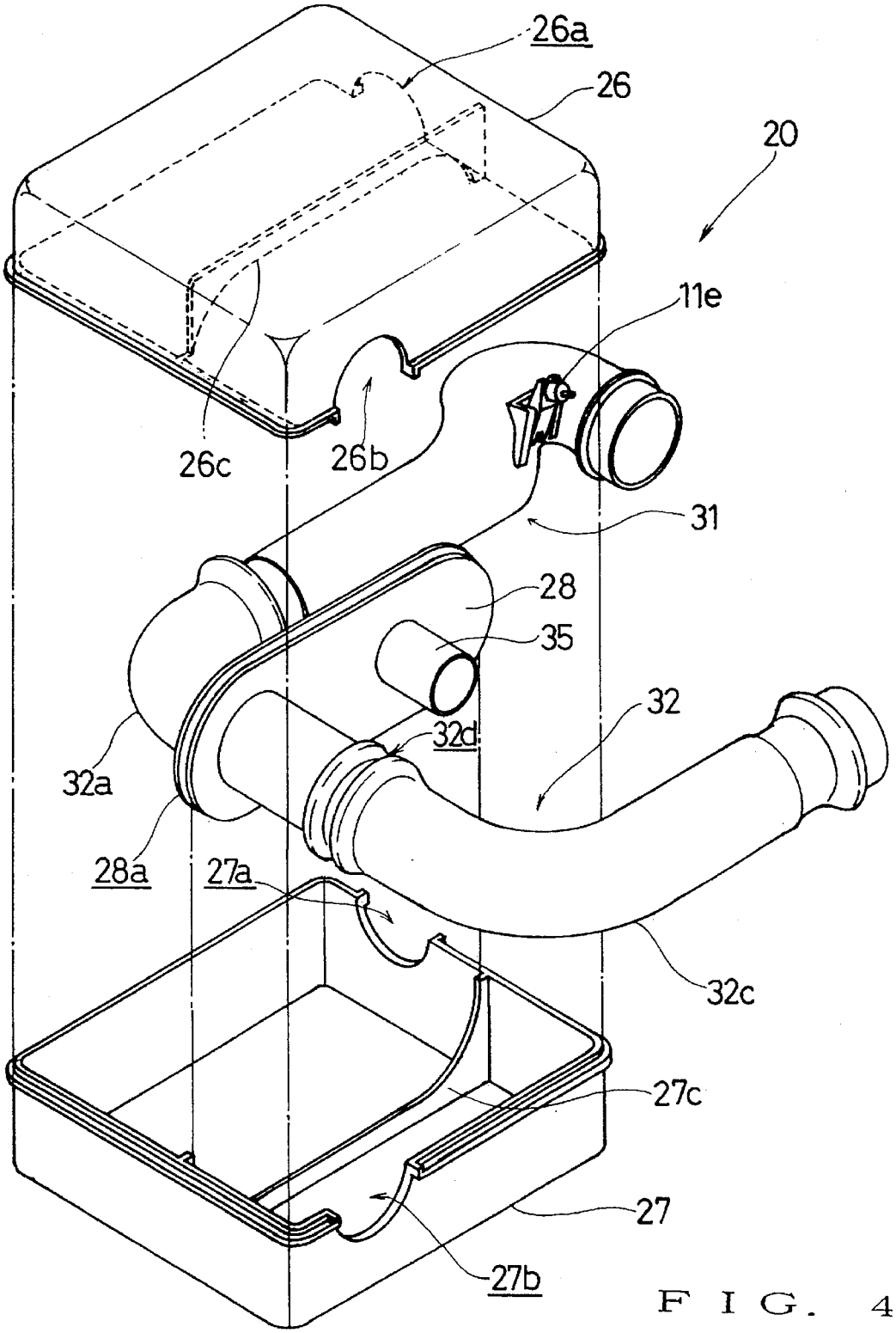
FIG. 4 is a disintegrated perspective view of a suction silencer apparatus according to another embodiment.
Figure 5:
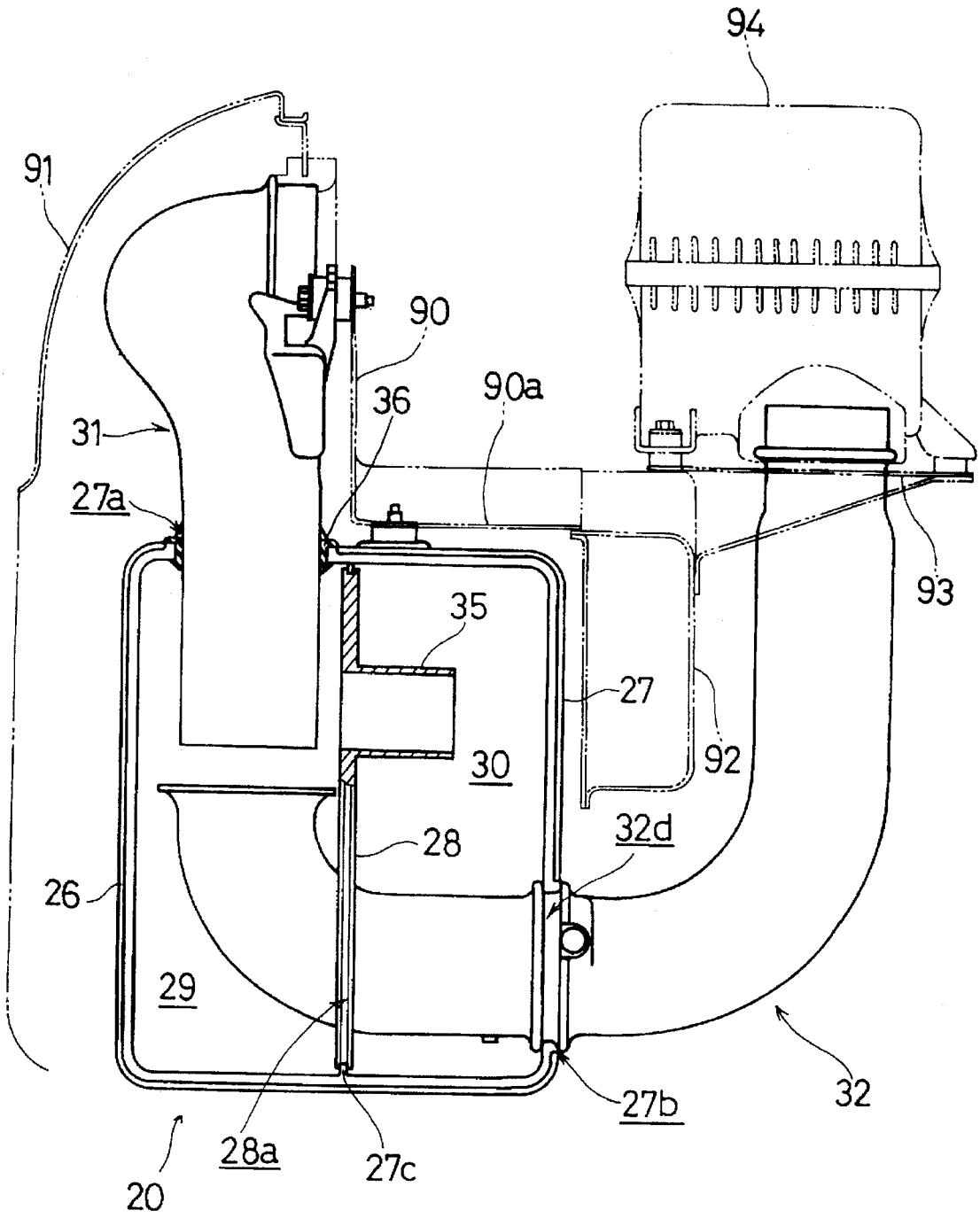
FIG. 5 is a front view of the suction silencer apparatus with a front side case removed.

FIG. 4 is a disintegrated perspective view of a suction silencer apparatus 20 according to the embodiment, and FIG. 5 is a front view of the suction silencer apparatus with a front side case 26 removed.

The duct member is composed of a first duct member 31 and a second duct member 32 similarly to the above-mentioned embodiment. The first duct member 31 has a quite same shape as the aforementioned first duct member 11. The second duct member 32 resembles the aforementioned second duct member 12 in its entire J-shape but has a partition plate 28 integrally formed on the upstream side half portion 32*a* instead of the aforementioned connecting pipe 15.

At a boundary part between the upstream side half portion 32*a* and the downstream side half portion 32*c* is formed a groove line 32*d* by two projection lines.

The partition plate 28 is of an elliptical shape having arcuate upper and lower edges and integrally fitted and fixed to the second duct member 32 penetrating it. At the upper end part of the partition plate 28 is projectingly formed a connecting pipe 35.

Around the peripheral surface of the partition plate 28 is formed a groove line 28*a*.

The silencer case is formed by combining split front side case 26 and rear side case 27 which are formed in rectangular box shapes and symmetrical with each other.

Both cases 26, 27 have semicircular recesses 26*a*, 27*a* formed at right side parts of the upper walls and semicircular recesses 26*b*, 27*b* formed at lower parts of left walls.

Inside the both cases 26, 27 are projected partition walls 26*c*, 27*c* for partitioning the interiors into right and left parts. The partition walls 26*c*, 27*c* have large cut recesses coinciding with the outer peripheral edges of the partition plate 28 at the middle portions.

Accordingly, when the front and rear cases 26, 27 are joined pinching the first and second duct member 31, 32 therebetween, the semicircular recesses 26*a*, 27*a* fit to the first duct member 31 through a rubber seal member 36, the semicircular recesses 26*b*, 27*b* fit to the groove line 32*d* of the second duct member 32, and the partition walls 26*c*, 27*c* fit to the outer peripheral groove line 28*a* of the partition plate 28 integral with the second duct member 32 to firmly fix the member 32. The first duct member 31 and the second duct member 32 assembled in such a manner take the same mutual positional relation as that of the aforementioned embodiment.

The interior of the silencer case is partitioned into two spaces by the partition plate 28 and the partition walls 26*c*, 27*c* fitting to each other. One of the two spaces in which the first duct member 31 is fitted forms an expansion chamber 29 and another space forms a resonance chamber 30.

The expansion chamber 26 and the resonance chamber 30 communicate with each other by the connecting pipe 35 provided to the partition plate 28.

The greater part of the resonance chamber 30 is positioned at the inner side of the U-shaped bent portion formed by the duct members 31, 32 and the connecting pipe 35 projects toward the resonance chamber 30 in the inner side of the bent portion.

As the suction silencer apparatus 20 is constructed as mentioned above, the air sucked in the first duct member 31 causes an expansion phenomenon in the expansion chamber 29 of the silencer case and a resonance phenomenon in the resonance chamber 30 through the connecting pipe 35 to reduce the suction noise.

Figure 6:
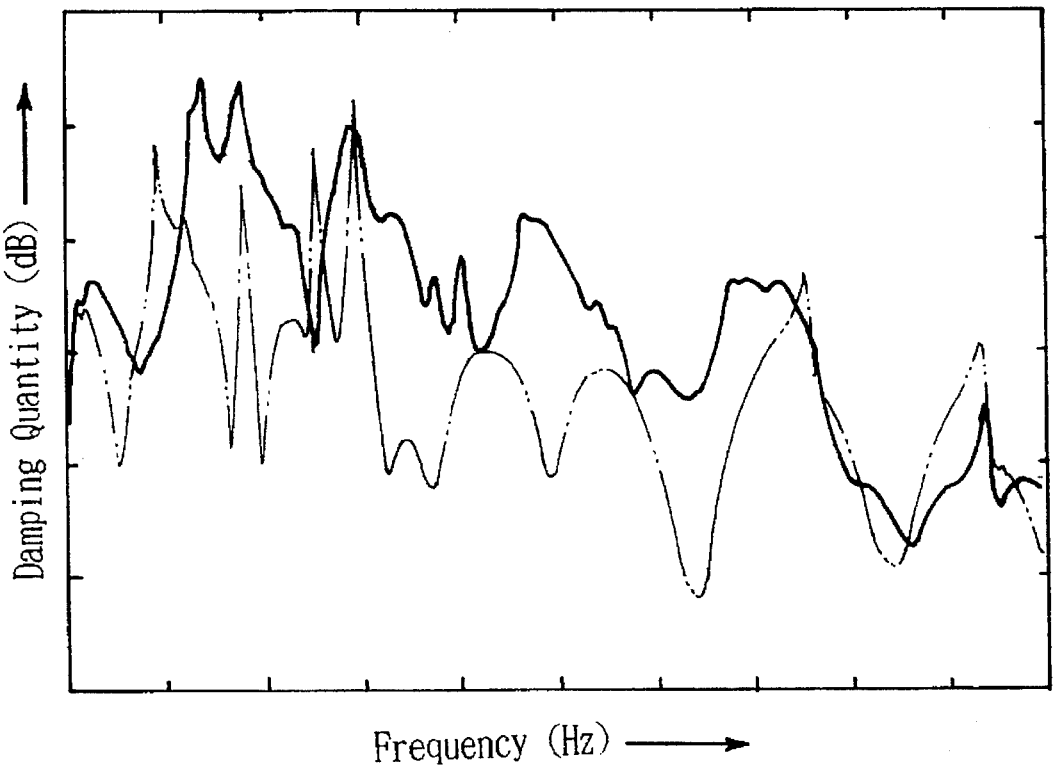
FIG. 6 is a graph showing sound damping curves which are results of experiments on the suction silencer apparatus.

FIG. 6 shows a result of an experiment on the suction silencer apparatus 20.

The experiment is a speaker test in which a specified sound is given from one end of the suction silencer apparatus 20 attached to the air cleaner 94 and damping quantities are measured. As the result of the experiment, a damping curve as shown in FIG. 6 by the solid line has been obtained. It is understood that a large damping quantity can be obtained over a wide frequency zone entirely.

For comparison, a similar experiment was carried out on a suction silencer apparatus which has a plurality of silencer apparatuses provided on different positions of a suction passage as the aforementioned prior art shown in the Japanese Publication and the result is shown by the double dotted chain line in FIG. 6.

It is clear that the suction silencer apparatus 20 according to the present invention is improved in comparison with the prior art suction silencer apparatus.

The expansion chamber 29 and the resonance chamber 30 are provided concentrated at one place of the duct member 31, 32 , the silencer case is provided on a part of the duct member 31, 32 bent in about U-shape, the resonance chamber 30 is positioned utilizing the space on the inner side of the bent portion of the duct member 31, 32 , and the connecting pipe 35 is provided at the inner side of the bent portion projecting toward the resonance chamber 30, therefore, a high space efficiency can be obtained.

Figure 7:
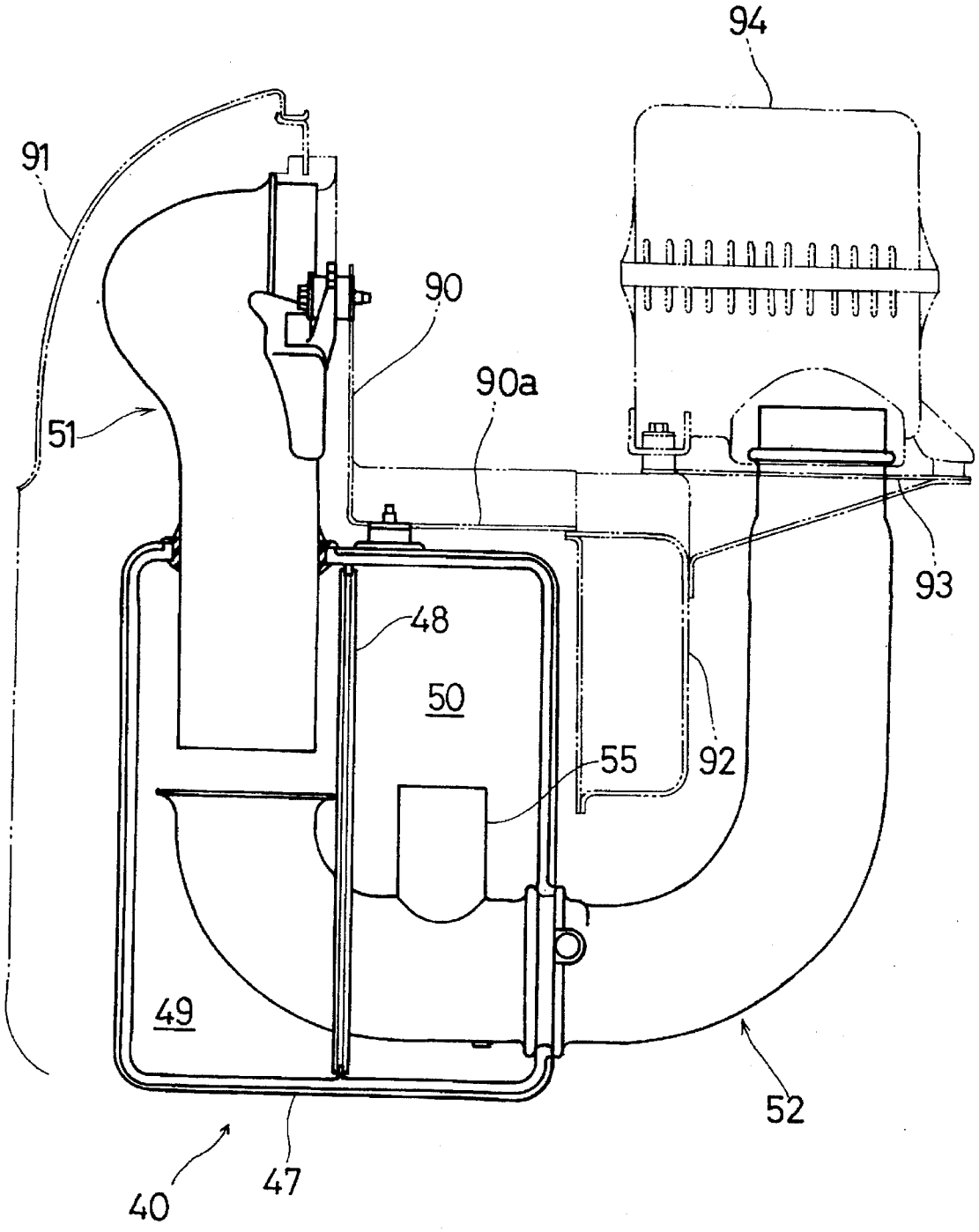
FIG. 7 is a front view of a suction silencer apparatus according to further another embodiment in which a front side case is removed.

FIG. 7 shows further another embodiment of the present invention.

The suction silencer apparatus 40 of the present embodiment is similar to the apparatus shown in FIGS. 4 and 5 basically. However, the connecting pipe 55 does not project from the partition plate 48, but projects into the resonance chamber 50 of the silencer case 47 from an upstream side portion of the second duct member 52.

The silencer case 47 itself is the same as that of the aforementioned embodiment, and the interior is partitioned by the partition plate 48 into the expansion chamber 49 and the resonance chamber 50.

Since the resonance chamber 50 is positioned utilizing the space on the inner side of the bent portion formed by the first duct member 51 and the second duct member 52 and the connecting pipe 55 projects into the resonance chamber 50 at the inner side of the bent portion, a high space efficiency and silencing performance etc. equal to the aforementioned embodiment are obtainable.

What is claimed is:

1. A suction silencer apparatus of an engine having a plurality of silencer chambers on a suction passage, comprising:

a first silencer chamber surrounding a bent portion of said suction passage and communicating with said suction passage;

a second silencer chamber arranged integrally with said first silencer chamber at an inner side of said bent portion of the suction passage; and connecting means arranged at said inner side of said bent portion of the suction passage for connecting said first silencer chamber with said second silencer chamber.

2. A suction silencer apparatus as claimed in claim 1, wherein said first and second silencer chambers are formed in a silencer case having split first and second cases combined together pinching therebetween a duct forming said suction passage.

3. A suction silencer apparatus as claimed in claim 1, wherein said first and second silencer chambers are formed in a silencer case of an angular shape and a duct forming said suction passage passes through an upper wall and a side wall of said silencer case.

4. A suction silencer apparatus as claimed in claim 3, wherein said duct comprises a first duct member passing through said upper wall and a second duct member passing through said side wall which face to each other at a predetermined interval within said silencer case.

5. A suction silencer apparatus as claimed in claim 4, wherein said connecting means is formed integrally on one of said duct members.

6. A suction silencer apparatus as claimed in claim 1, wherein said second silencer chamber is close to a side frame and enclosed together with said side frame by a duct.

7. A suction silencer apparatus of an engine having a plurality of silencer chambers on a suction passage, comprising:

a silencer apparatus surrounding a bent portion of said suction passage;

a partition wall partitioning an interior of said silencer apparatus into outer and inner portions positioned on outer and inner sides of said bent portion, respectively;

a silencer expansion chamber formed by said outer portion in said silencer apparatus;

a silencer resonance chamber formed by said inner portion in said silencer apparatus; and a connecting pipe for connecting said silencer expansion chamber with said silencer resonance chamber arranged at said inner side of said bent portion extruding into said silencer resonance chamber.

8. A suction silencer apparatus as claimed in claim 7, wherein said silencer apparatus comprises a silencer case having split first and second cases combined together pinching therebetween a duct forming said suction passage.

9. A suction silencer apparatus as claimed in claim 8, wherein said partition wall comprises a partition wall part integrally projecting from an inner surface of said silencer case and a partition plate engaging with said partition wall part.

10. A suction silencer apparatus as claimed in claim 9, wherein said partition plate is of an elliptical shape.

11. A suction silencer apparatus as claimed in claim 9, wherein said connecting pipe is formed in a body with said partition plate.

12. A suction silencer apparatus as claimed in claim 7, wherein said silencer apparatus comprises a silencer case of an angular shape and a duct forming said suction passage passes through an upper wall and a side wall of said silencer case.

13. A suction silencer apparatus as claimed in claim 12, wherein said duct comprises a first duct member passing through said upper wall and a second duct member passing through said side wall which face to each other at a predetermined interval within said silencer case.

14. A suction silencer apparatus as claimed in claim 7, wherein said connecting pipe is enclosed together with a side frame by a duct.

15. A suction silencer apparatus of an engine having a plurality of silencer chambers formed in a silencer case, in which said silencer case comprises a case split into first and second halves which when combined together respectively pinch opposite sides of a duct passing through said plurality of silencer chambers, said duct comprises first and second duct members arranged in a common plane, each of said first and second duct members pinched by said first and second halves of said case.

16. A suction silencer apparatus as claimed in claim 15, wherein said silencer case is of an angular shape and said duct passes through an upper wall and a side wall of said silencer case.

17. A suction silencer apparatus as claimed in claim 16, wherein said first duct member passing through said upper wall and said second duct member passing through said side wall, said first and second duct members face toward each other at a predetermined interval within said silencer case.

18. A suction silencer apparatus as claimed in claim 15, wherein said plurality of silencer chambers are formed in said silencer case by a separate partition plate pinched and supported by said first and second halves.

19. A suction silencer apparatus as claimed in claim 18, wherein said partition plate is of an elliptical shape and a connecting pipe communicating with said silencer chambers is formed in a body with said partition plate.

20. A suction silencer apparatus as claimed in claim 15, wherein said plurality of silencer chambers include a silencer chamber of a smaller capacity which is close to a side frame and which is surrounded, together with said side frame, by a duct.

* * * * *

UNITED STATES PATENT AND TRADEMARK OFFICE

CERTIFICATE OF CORRECTION

PATENT NO. : 5,647,314

DATED : July 15, 1997

INVENTOR(S) : MATSUMURA et al.

It is certified that error appears in the above-indentified patent and that said Letters Patent is hereby corrected as shown below:

On title page,

Item [73], line 2, please delete "Kabushikikaisha" insert therefor -- Kabushiki Kaisha --.

Signed and Sealed this

Second Day of December, 1997

*Attest:*

Bruce Lehman

BRUCE LEHMAN

*Attesting Officer*

*Commissioner of Patents and Trademarks*